US008260181B2

(12) United States Patent
Murayama

(10) Patent No.: US 8,260,181 B2
(45) Date of Patent: Sep. 4, 2012

(54) IMAGE FORMING APPARATUS THAT DETECTS POSITIONAL DEVIATION BETWEEN IMAGES FORMED BY DIFFERENT IMAGE FORMING UNITS

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 323 days.

(21) Appl. No.: 12/726,363

(22) Filed: Mar. 18, 2010

(65) Prior Publication Data

US 2011/0026979 A1 Feb. 3, 2011

(30) Foreign Application Priority Data

Jul. 31, 2009 (JP) ..... 2009-178981

(51) Int. Cl.
*G03G 15/01* (2006.01)

(52) U.S. Cl. ..... 399/302; 399/301; 347/116

(58) Field of Classification Search ..... 399/301, 399/302; 347/116–118; 198/806
See application file for complete search history.

(56) References Cited

U.S. PATENT DOCUMENTS

| | | | | |
|---|---|---|---|---|
| 5,278,625 | A * | 1/1994 | Charnitski et al. | 399/178 |
| 5,442,388 | A * | 8/1995 | Schieck | 347/116 |
| 5,978,003 | A * | 11/1999 | Brenner, Jr. | 347/116 |
| 6,104,899 | A * | 8/2000 | Hokari et al. | 399/165 |
| 6,115,572 | A * | 9/2000 | Edwards et al. | 399/162 |
| 6,137,517 | A * | 10/2000 | Furst et al. | 347/116 |
| 7,448,745 | B2 * | 11/2008 | Kibayashi | 347/104 |
| 2006/0140686 | A1 * | 6/2006 | Spilz et al. | 399/301 |
| 2008/0145115 | A1 * | 6/2008 | Spence et al. | 399/322 |
| 2008/0225307 | A1 | 9/2008 | Murayama et al. | |
| 2008/0226359 | A1 * | 9/2008 | Murayama | 399/301 |
| 2008/0291477 | A1 | 11/2008 | Murayama | |
| 2008/0292370 | A1 | 11/2008 | Murayama | |
| 2009/0196662 | A1 * | 8/2009 | Boness et al. | 399/301 |
| 2010/0232819 | A1 * | 9/2010 | Kudo et al. | 399/66 |

FOREIGN PATENT DOCUMENTS

JP 10-274888 A 10/1998

(Continued)

OTHER PUBLICATIONS

JP Decision to Grant dated Nov. 1, 2011 received in corresponding Application No. P2009-178981; English Translation.

*Primary Examiner* — David Gray
*Assistant Examiner* — G. M. Hyder
(74) *Attorney, Agent, or Firm* — Banner & Witcoff, Ltd.

(57) ABSTRACT

An image forming apparatus is provided. The image forming apparatus includes a moving body which moves in a moving direction; a plurality of formation units which are provided to oppose the moving body, respectively, and align in an alignment direction, and which sequentially form images directly on the moving body or an image forming medium transported on the moving body; a detection section which outputs a detection signal corresponding to a position of a mark which is formed directly on the moving body or the image forming medium by each of the formation units; and a measurement section which specifies a positional relationship between marks formed by at least two formation units based on the detection signal from the detection section, and which measures a deviation angle between the moving direction of the moving body and the alignment direction of the formation units based on the specified positional relationship.

9 Claims, 16 Drawing Sheets

FOREIGN PATENT DOCUMENTS

| | | | |
|---|---|---|---|
| JP | 2000-098810 | A | 4/2000 |
| JP | 2002-040744 | A | 2/2002 |
| JP | 2005-309310 | | 11/2005 |
| JP | 2007-233193 | A | 9/2007 |
| JP | 2008-225192 | | 9/2008 |
| JP | 2008-292811 | | 12/2008 |
| JP | 2008-292812 | | 12/2008 |

* cited by examiner

IMAGE FORMING APPARATUS THAT DETECTS POSITIONAL DEVIATION BETWEEN IMAGES FORMED BY DIFFERENT IMAGE FORMING UNITS

CROSS-REFERENCE TO RELATED APPLICATION

This application claims priority from Japanese Patent Application No. 2009-178981, filed on Jul. 31, 2009, the entire subject matter of which is incorporated herein by reference.

TECHNICAL FIELD

Aspects of the present invention relate to an image forming apparatus.

BACKGROUND

An image forming apparatus includes a plurality of formation units which are aligned along a sheet transport belt, and sequentially forms each color image on a sheet transported on the belt by each formation unit. In such an image forming apparatus, a technique called registration is employed to reduce or prevent deviation (positional deviation) of an image forming position of each color on the sheet between the formation units.

The image forming apparatus which employs this technique includes an optical sensor having a light emitting section and a light receiving section. The light emitting section emits light to the belt, and the light receiving section receives the reflected light and outputs a light receiving signal corresponding to the amount of received light. Moreover, when performing the registration, a mark is formed on the belt by each formation unit. Then, the position of the mark is determined by reading the variation of reflectance (amount of reflected light) between the belt surface and the mark surface based on the light receiving signal from the light receiving section, and deviation of the image forming position is corrected based on the determination result.

However, in the image forming apparatus, a relative deviation angle could occur between the alignment direction of the plurality of formation units and the transport direction of the belt. This deviation angle would cause a problem which cannot be corrected by the above-described registration technique. However, measures against the deviation angle were not sufficiently studied in the related-art image forming apparatus.

SUMMARY

Accordingly, it is an aspect of the present invention to provide an image forming apparatus capable of realizing at least one of measuring the relative deviation angle between the alignment direction of a plurality of formation units and the movement direction of a moving body of an image formed by the formation units and suppressing an image variation caused by the deviation angle.

According to an illustrative embodiment of the present invention, there is provided an image forming apparatus comprising: a moving body which is configured to move in a moving direction; a plurality of formation units which are provided to oppose the moving body, respectively, and align in an alignment direction, and which are configured to sequentially form images directly on the moving body or an image forming medium transported on the moving body; a detection section which is configured to output a detection signal corresponding to a position of a mark which is formed directly on the moving body or the image forming medium transported on the moving body by each of the formation units; and a measurement section which is configured to specify a positional relationship between marks, which are formed by at least two formation units, based on the detection signal from the detection section, and which is configured to measure a deviation angle between the moving direction of the moving body and the alignment direction of the formation units based on the specified positional relationship.

According to the above illustrative embodiment, it is possible to realize at least one of measuring the relative deviation angle between the alignment direction of the image forming positions of a plurality of formation units and the movement direction of the moving body of an image formed by the formation units and suppressing an image variation caused by the deviation angle.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Illustrative embodiments of the present invention will be described with reference to the accompanying drawings.

(Overall Configuration of a Printer)

Figure 1:
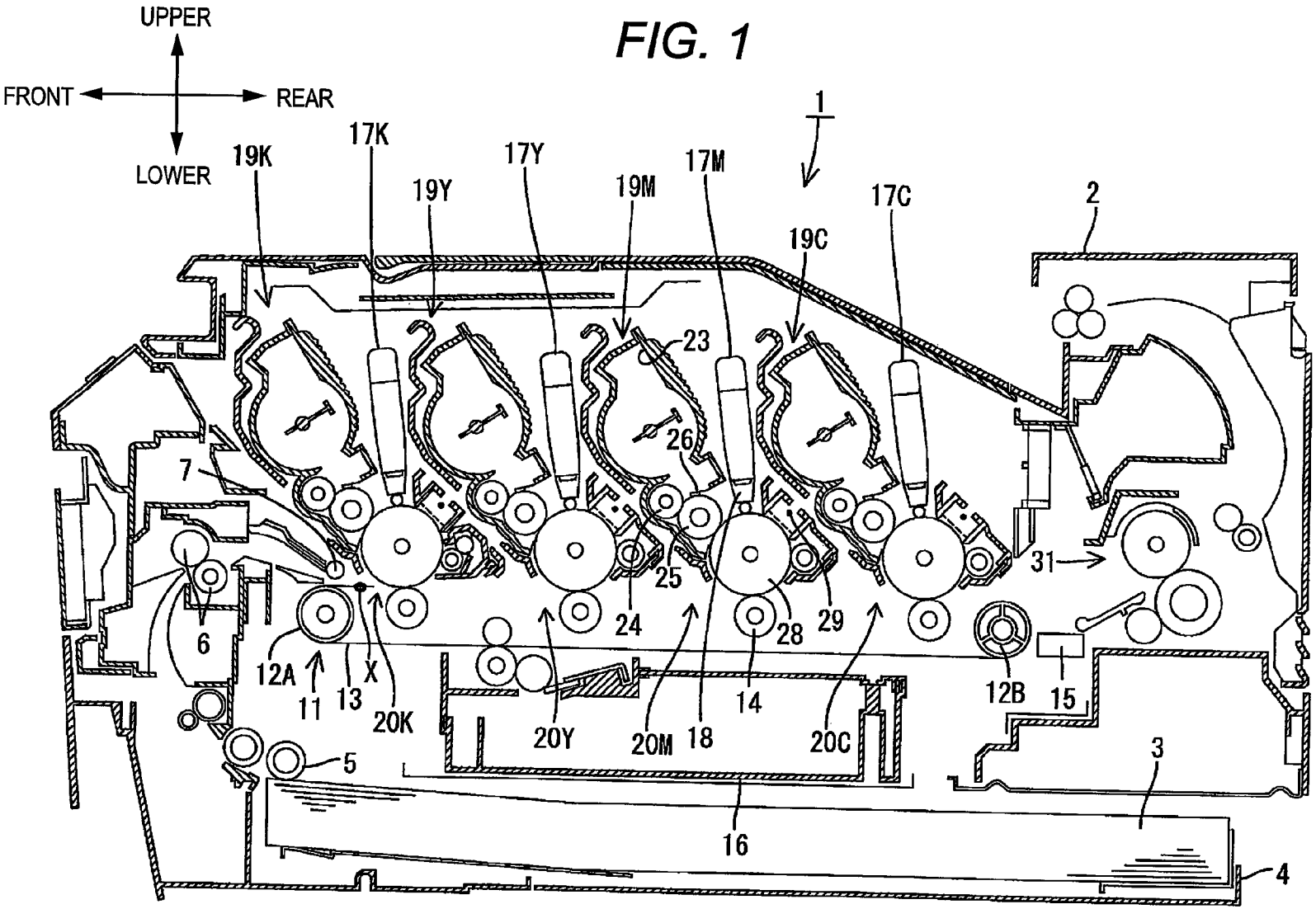
FIG. 1 is a side sectional view showing the schematic configuration of a printer according to an illustrative embodiment of the present invention.

As shown in FIG. 1, a printer 1 (as an example of an image forming apparatus) is a direct transfer type color printer which forms a color image using toner of four colors (black K, yellow Y, magenta M, and cyan C).

As shown by arrows in FIG. 1, the left side of the drawing is a front side of the printer 1 and the right side of the drawing is a rear side of the printer 1. A direction perpendicular to the sheet of FIG. 1 is a left-right direction of the printer 1. In the following description, K (black), C (cyan), M (magenta), and Y (yellow) which mean respective colors are attached to the ends of reference numerals of constituent components when distinguishing the components or terms of the printer 1 for each color.

The printer 1 includes a casing 2. The printer 1 further includes, in a bottom portion of the casing 2, a tray 4 in which a plurality of sheets 3 (specifically, a sheet or an OHP sheet as an example of an image forming medium) can be loaded. Above the front upper end of the tray 4, a pickup roller 5 is provided. The pickup roller 5 is rotatably driven and feeds the uppermost sheet 3 of the sheets 3 loaded in the tray 4, to a registration roller 6. The registration roller 6 transports the sheet 3 onto a belt unit 11 after performing skew correction of the sheet 3.

In addition, an absorption roller 7 (an example of a pressure member) is provided at the downstream side of the registration roller 6. The absorption roller 7 is rotatably supported above the front upper end of the belt unit 11 and causes the leading end of the sheet 3, which has been transported from the registration roller 6, to be turn toward the belt unit 11 and pressed on the surface of a belt 13. Herein, the position on the belt 13 against which the leading end of the sheet 3 is pressed by the absorption roller 7 is referred to as "a pressed position X" (an example of a reference point).

The belt unit 11 includes a pair of support rollers 12A and 13B, and the endless belt 13 (an example of a moving body) which is looped around the pair of support rollers 12A and 12B. The belt 13 is formed of a resin material, such as polycarbonate, and the surface of the belt 13 is mirror-finished. The belt 13 rotates clockwise in the drawing by rotation of the support roller 12B provided on the rear side and transports the sheet 3 on the upper surface. Four transfer rollers 14 are provided at the inner side of the belt 13. Each transfer roller 14 opposes a photosensitive drum 28 of corresponding process section 19K, 19Y, 19M and 19C (described later) with the belt 13 interposed therebetween.

A mark sensor 15 (an example of a detection section) for determining the position of a mark M, which is formed on the surface of the belt 13 when performing correction processing (described later), is provided at the back end side of the belt 13. A cleaning device 16 which collects toner, sheet particles, and the like adhering to the surface of the belt 13 is provided below the belt unit 11.

Four exposure sections 17K, 17Y, 17M, and 17C and the four process sections 19K, 19Y, 19M, and 19C are provided above the belt unit 11 so as to be aligned in the front-rear direction. One formation unit 20 includes one of the exposure sections 17K, 17Y, 17M and 17C, one of the process sections 19K, 19Y, 19M and 19C, and one of the above-described transfer rollers 14. In the entire printer 1, four formation units 20K, 20Y, 20M, and 20C respectively corresponding to the colors black, yellow, magenta, and cyan are provided.

Each of the exposure sections 17K, 17Y, 17M and 17C has an LED head 18 including a plurality of LEDs arranged in a line. Emission control of each of the exposure sections 17K, 17Y, 17M and 17C is performed based on the image data to be formed, and each of the exposure sections 17K, 17Y, 17M and 17C performs exposure by emitting light from the LED head 18 to the surface of the opposing photosensitive drum 28 on line-by-line basis.

Hereinafter, the alignment direction of the four process sections 19K, 19Y, 19M, and 19C (four photosensitive drums 28) is referred to as a "sub-scanning direction" (an example of the alignment direction of formation units). Further, a direction perpendicular to the sub-scanning direction is referred to as a "main scanning direction" (an example of a direction perpendicular to the alignment direction). In this illustrative embodiment, the main scanning direction matches the arrangement direction of the plurality of LEDs.

Each of the process sections 19K, 19Y, 19M and 19C has a toner accommodating chamber 23 for accommodating toner of corresponding color (an example of developer) and includes a supply roller 24, a developing roller 25, a layer thickness regulating blade 26, and the like below the toner accommodating chamber 23. Toner discharged from the toner accommodating chamber 23 is supplied to the developing roller 25 by rotation of the supply roller 24 and is positively charged by friction between the supply roller 24 and the developing roller 25.

The toner supplied onto the developing roller 25 is conveyed between the layer thickness regulating blade 26 and the developing roller 25 with the rotation of the developing roller 25. The toner is sufficiently charged by friction between the layer thickness regulating blade 26 and the developing roller 25 and is then held on the developing roller 25 as a thin layer with a uniform thickness.

In each of the process sections 19K, 19Y, 19M and 19C, the photosensitive drum 28 having a surface covered by a positively chargeable photosensitive layer, and a scorotron-type charger 29 are provided. When forming an image, the photosensitive drum 28 is driven to rotate, and the surface of the photosensitive drum 28 is uniformly charged positively by the charger 29. The positively charged portion is exposed by each of the exposure sections 17K, 17Y, 17M and 17C. Accordingly, an electrostatic latent image is formed on the surface of the photosensitive drum 28.

Subsequently, the toner on the developing roller 25 is supplied to the electrostatic latent image, so that the electrostatic latent image is formed as a toner image which is a visible image. Then, the toner image formed on the surface of each photosensitive drum 28 is sequentially transferred onto the sheet 3 by a negative transfer voltage applied to the transfer roller 14 while the sheet 3 is passing through each transfer position between the photosensitive drum 28 and the transfer roller 14. Then, the sheet 3 on which the toner image has been transferred is transported to a fixing device 31, and the toner image is fixed by heat. Then, the sheet 3 is transported upward to be discharged to the upper surface of the casing 2.

(Electrical Configuration of a Printer)

Figure 2:
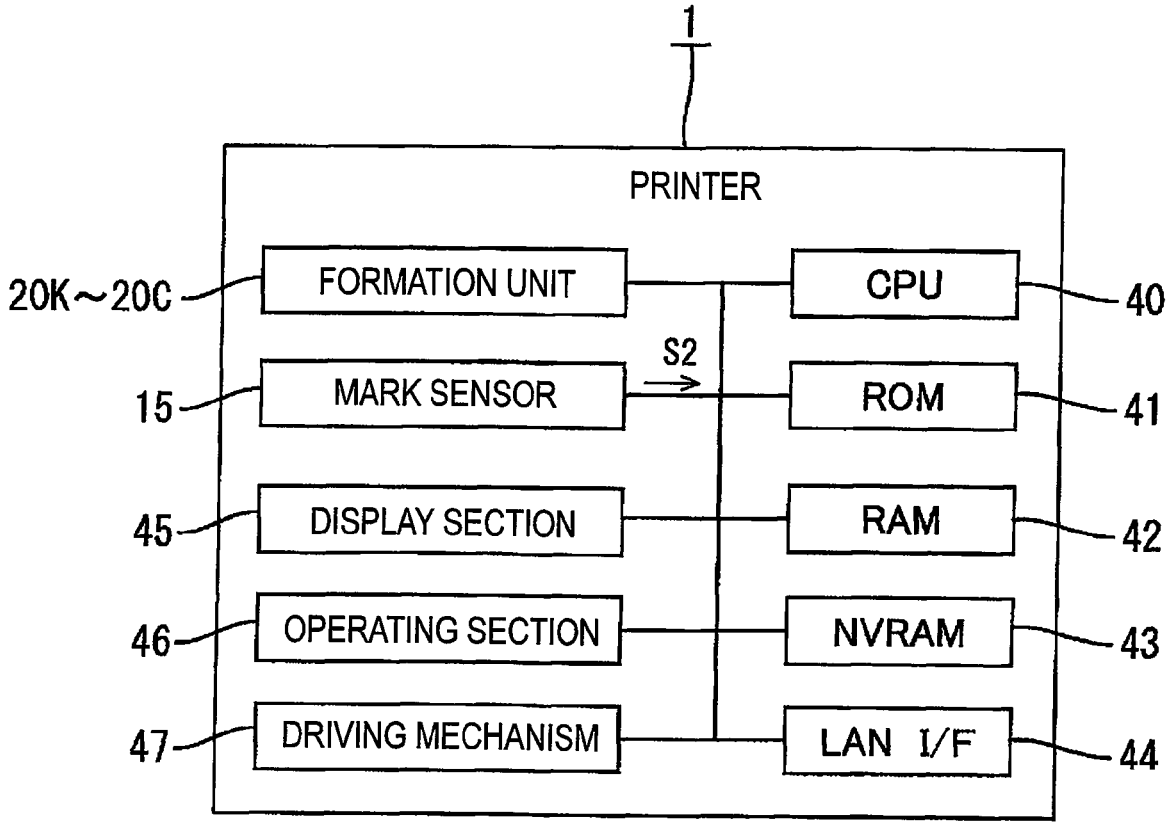
FIG. 2 is a block diagram schematically showing the electrical configuration of the printer.

As shown in FIG. 2, the printer 1 includes a Central Processing Unit (CPU) 40 (an example of a measurement section and a correction section), a Read Only Memory (ROM) 41, a Random Access Memory (RAM) 42, a nonvolatile RAM (NVRAM) 43, and a network interface 44. The above-described formation units 20K, 20Y, 20M and 20C and the mark sensor 15, a display section 45, an operating section 46, and a driving mechanism 47 are connected to these.

A program for performing various operations of the printer 1, such as correction processing (described later), is stored in the ROM 41. The CPU 40 controls each section according to the program read from the ROM 41 while storing the processing result in the RAM 42 or the NVRAM 43. The network interface 44 is connected to an external computer (not shown)

through a communication line, so that data communication can be performed between the network interface 44 and the external computer.

The display section 45 has a liquid crystal display, a lamp, and the like. The display section 45 can display various kinds of setting screens, operating states of the apparatus, and the like. The operating section 46 has a plurality of buttons. Using the operating section 46, the user can perform various kinds of input operations. The driving mechanism 47 has a driving motor and the like and drives the belt 13 to rotate.

(Configuration of a Mark Sensor)

Figure 3:
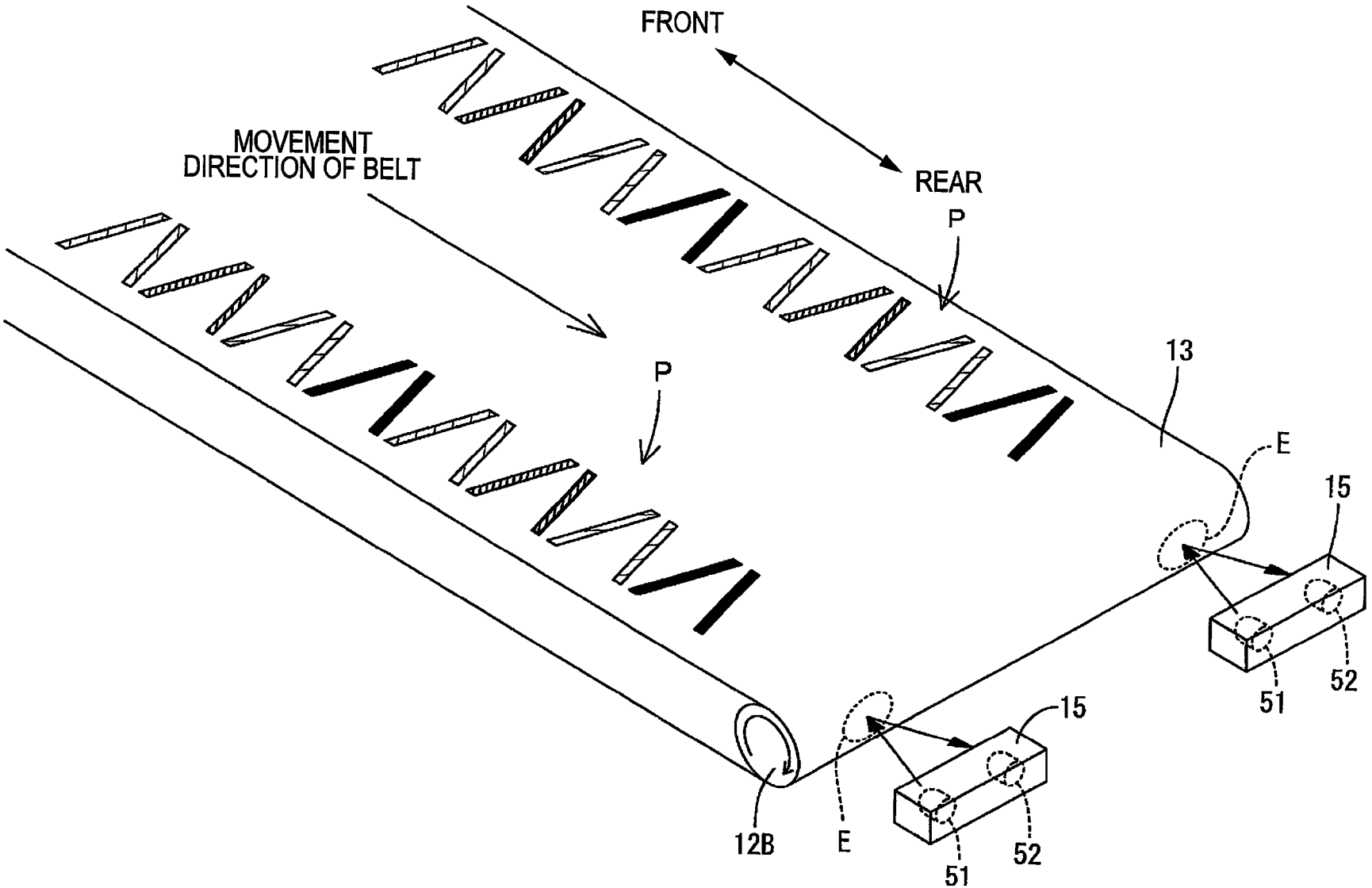
FIG. 3 is a perspective view showing a mark sensor and a belt.

As shown in FIG. 3, one or plural mark sensors 15 (for example, two mark sensors 15 in this illustrative embodiment) are provided in lower portions at the rear side of the belt 13, and the two mark sensors 15 are arranged in the left-right direction. Each mark sensor 15 is a reflective optical sensor which includes a light emitting element 51 (for example, an LED) and a light receiving element 52 (for example, a phototransistor). Specifically, the light emitting element 51 emits light onto the surface of the belt 13 from the oblique direction, and the light receiving element 52 receives the reflected light from the surface of the belt 13. The spot area formed on the belt 13 by the light from the light emitting element 51 is a detection region E of the mark sensor 15.

Figure 4:
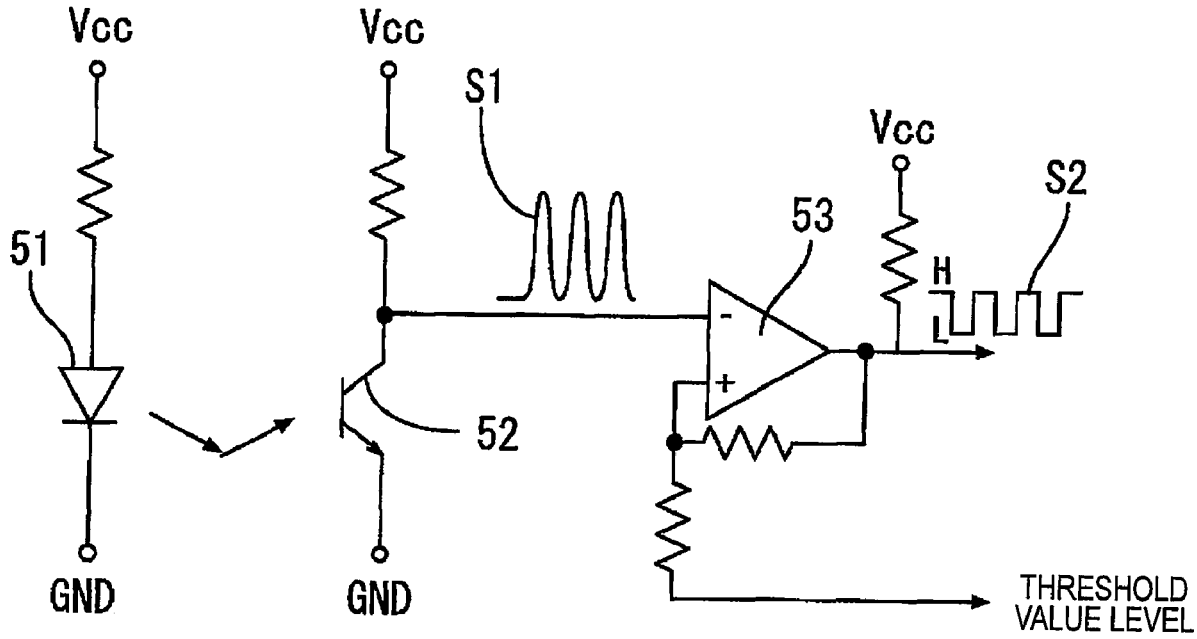
FIG. 4 is a view showing the circuit configuration of a mark sensor.

FIG. 4 is a circuit diagram of the mark sensor 15. A light receiving signal S1 from the light receiving element 51 becomes a lower level as the amount of received light in the light receiving element 52 is higher, and becomes a higher level as the amount of received light is lower. The light receiving signal S1 is input to a hysteresis comparator 53. The hysteresis comparator 53 compares the level of the light receiving signal S1 with a threshold value (first threshold value TH1, second threshold value TH2) and outputs a binary signal S2 (an example of a detection signal) whose level is inverted according to the comparison result.

(Configuration of a Correction Pattern)

Figure 5:
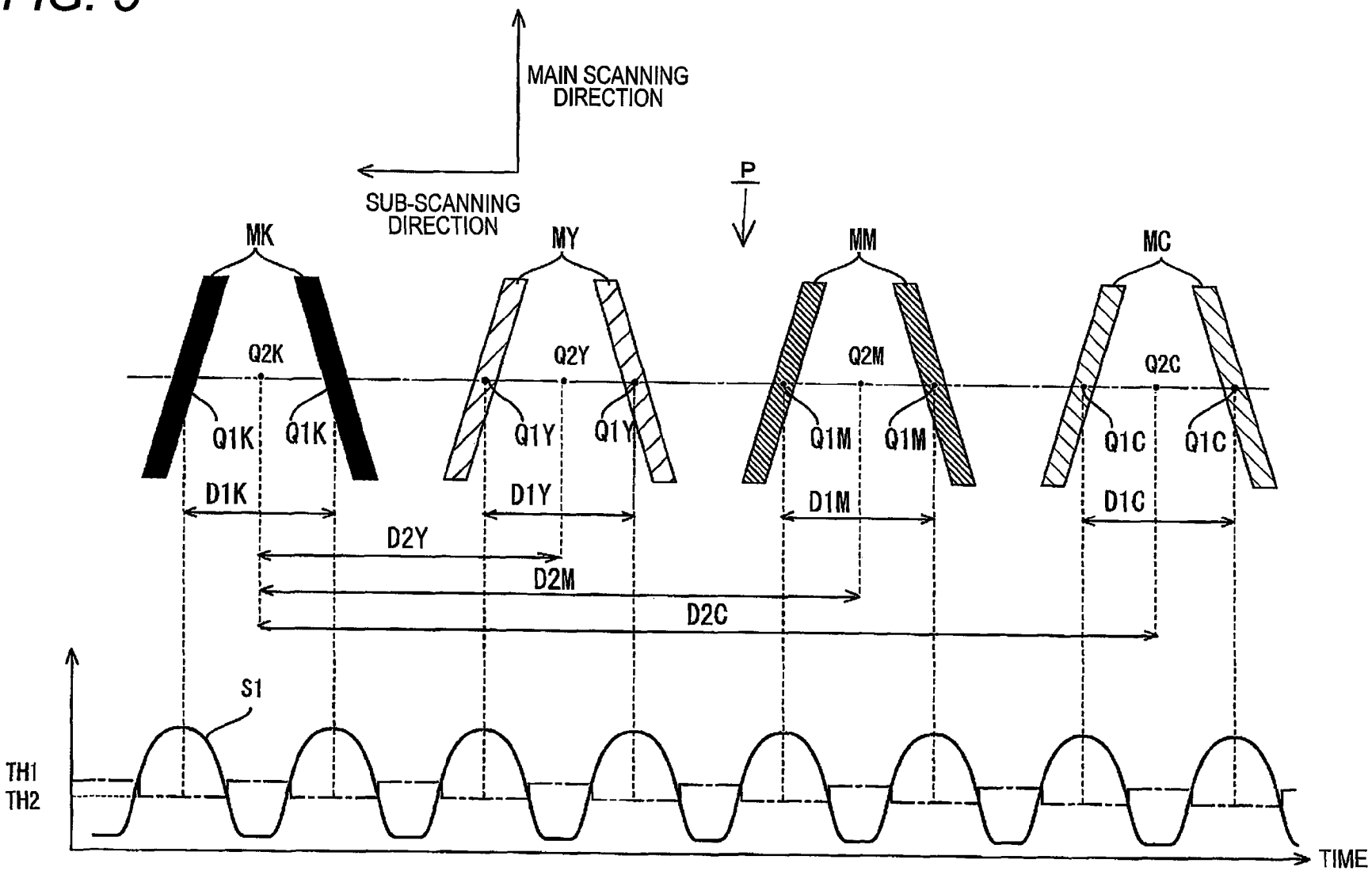
FIG. 5 is a view showing the relationship between a correction pattern and a waveform of a light receiving signal.

In FIG. 5, the configuration of a correction pattern P is shown in the upper portion, and the waveform of the light receiving signal S1 when the mark M of each color, which configures the correction pattern P, passes the detection region E is shown in the lower portion. The left and right direction in FIG. 5 corresponds to the sub-scanning direction.

The correction pattern P is used to measure the amount of positional deviation between color images formed by the respective formation units 20 in the main scanning direction and the sub-scanning direction, and measure a deviation angle θ between the sub-scanning direction and the movement direction of the belt 13. It is noted that in this illustrative embodiment, black is set as a reference color and yellow, magenta, and cyan are set as adjustment colors. The positional deviation is corrected by adjusting the image forming position of each adjustment color based on the image forming position of the reference color.

The correction pattern P includes one or plural mark groups (in FIG. 5, only one mark group is shown) having a black mark MK, a yellow mark MY, a magenta mark MM, and a cyan mark MC aligned in this order along the substantially sub-scanning direction. Each mark M has a pair of stripe-shaped marks, and each of the pair of stripe-shaped marks is inclined by a predetermined angle from a straight line extending in the main scanning direction. Additionally, the pair of stripe-shaped marks is symmetrical with respect to the straight line.

In this illustrative embodiment, since the belt 13 is mirror-finished as described above, the reflectance of the belt 13 is higher than that of the toner corresponding to any of the four colors. Therefore, as shown in the lower portion of FIG. 5, when light from the light emitting element 51 is emitted onto the base of the belt 13 (surface of the belt 13 on which the mark M is not formed), the level of the light receiving signal S1 becomes lowest. On the other hand, when the light from the light emitting element 51 is emitted onto the mark M formed on the belt 13, the level of the received light amount in the light receiving element 52 becomes low, so that the level of the light receiving signal S1 becomes high.

The CPU 40 calculates the intermediate position Q (intermediate timing) between the falling edge and the rising edge of the binary signal S2, for example. This intermediate position is set as a position Q1 of each stripe-shaped mark of each mark M, and the intermediate position of the positions Q1 of the stripe-shaped marks for each mark M is set as a position Q2 in the sub-scanning direction of each mark M.

Hereinafter, a positional distance (Q1K-Q1K, Q1Y-Q1Y, Q1M-Q1M, Q1C-Q1C) between the stripe-shaped marks in each mark M is referred to as a mark width D1. The mark width D1 varies according to the position in the main scanning direction of each mark M. In addition, a positional distance (Q2K-Q2Y, Q2K-Q2M, Q2K-Q2C) between each of the marks MY, MM, and MC of the adjustment colors and the reference color mark MK in the sub-scanning direction is referred to as an inter-mark distance D2. The inter-mark distance D2 varies according to the amount of positional deviation of an adjustment color image with respect to the reference color image in the sub-scanning direction.

(Image Deviation Caused by the Deviation Angle)

FIGS. 6A to 6E are schematic views showing the process in which, for example, a linear image G is formed on the sheet 3 by each formation unit 20 in a state where the sub-scanning direction and the movement direction of the belt 13 relatively deviate from each other by the deviation angle θ. Each linear image G is an image which extends along the main scanning direction, and in which the intermediate position substantially matches a centerline L1 of an image formable region N of each formation unit 20 (photosensitive drum 28) where an image can be formed.

Thus, when the sub-scanning direction and the movement direction of the belt 13 deviate from each other (when the deviation angle θ occurs), an image deviation, that is, "center deviation" or "positional deviation (positional deviation between images of respective colors)" occurs according to the deviation angle θ. In this illustrative embodiment, it is assumed that forming the entire image in a center position of the sheet 3 in the main scanning direction is ideal, and the "center deviation" means positional deviation of the entire image with respect to the center position of the sheet 3. Hereinafter, a specific example will be described.

Figure 6A:
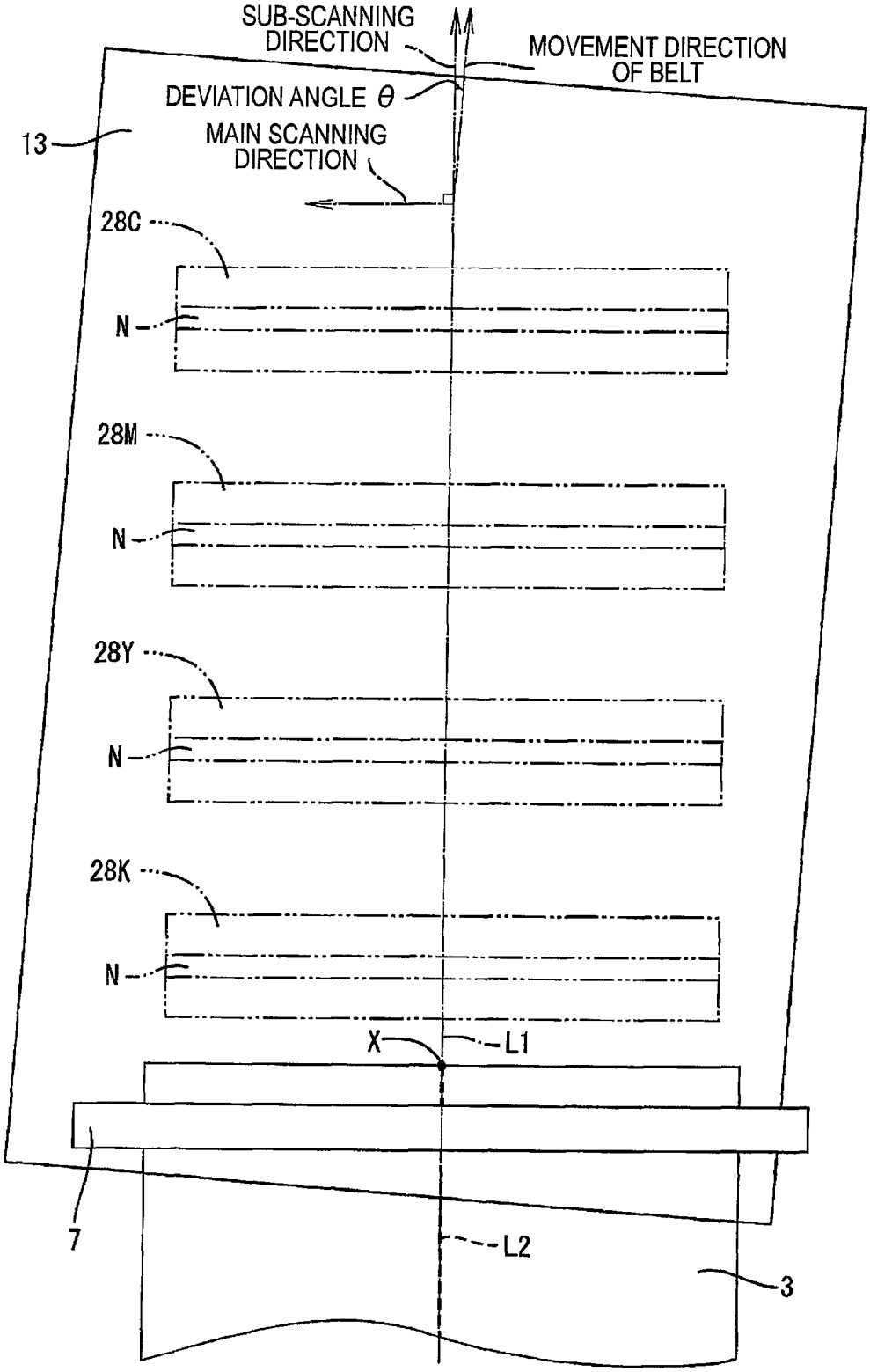
FIG. 6A is a schematic view showing a state where a sheet is pressed against a belt surface, when viewed from the above of the belt.

First, as shown in FIG. 6A, the leading end of the sheet 3 is pressed against the pressed position X by the absorption roller 7. As shown in FIG. 6A, it is assumed that the centerline L1 of the image formable region N substantially matches a centerline L2 of the sheet 3 until this point of time. Accordingly, if the deviation angle θ is substantially zero (the deviation angle does not exist), the sheet 3 is subsequently transported to the image formable region N of each formation unit 20 in a state where the centerline L1 substantially matches the centerline L2 of the sheet 3. In this case, it is possible to form a normal image in which the above-described center deviation and the positional deviation do not occur.

Figure 6B:
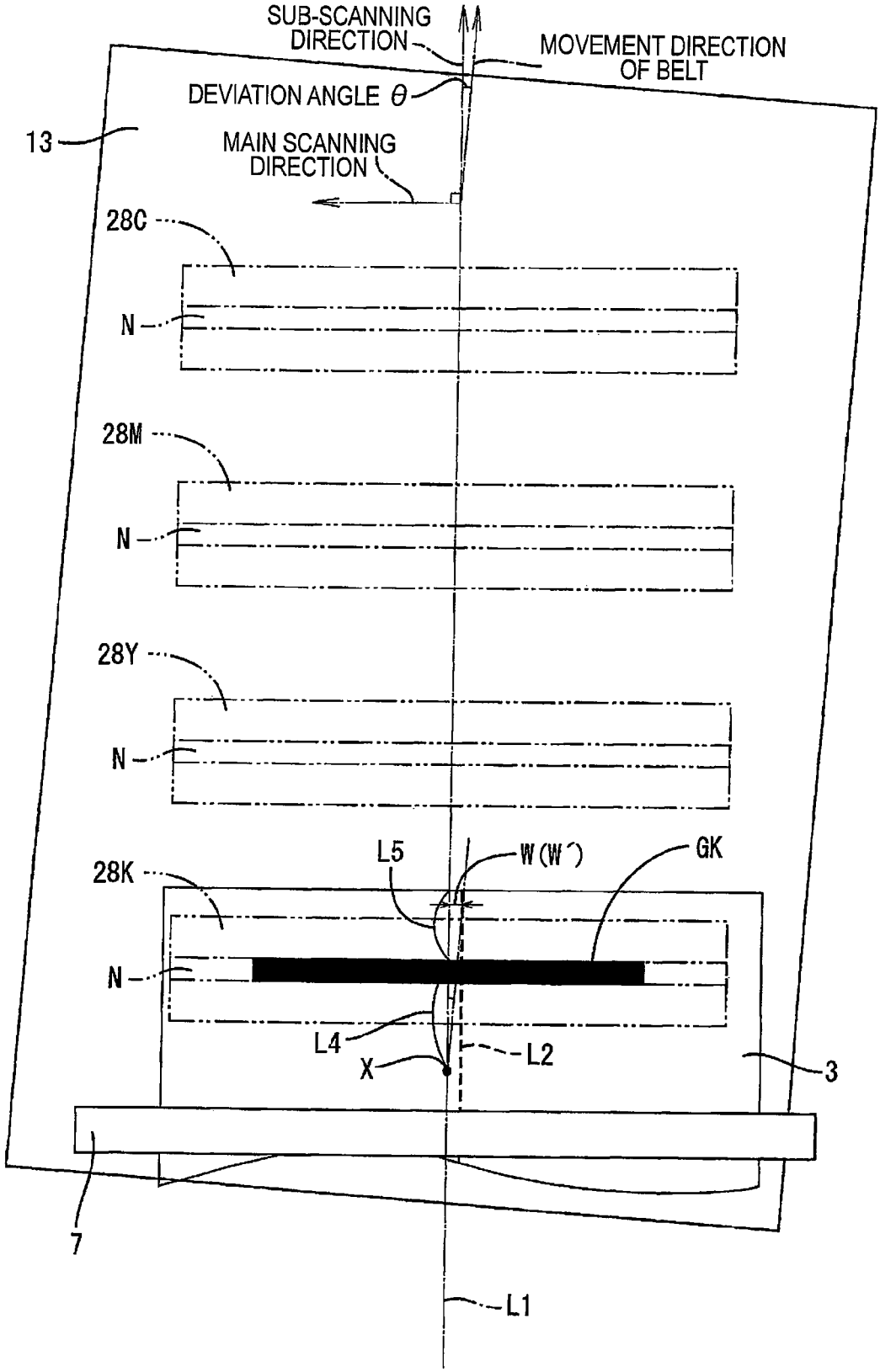
FIG. 6B is a schematic view showing a state where a linear image of black is formed on a sheet, when viewed from the above of the belt.

However, if the deviation angle θ exists, the sheet 3 is transported in a direction (the movement direction of the belt 13) which is inclined by the deviation angle θ with respect to the sub-scanning direction while the leading end of the sheet 3 maintains the posture along the main scanning direction. Therefore, as shown in FIG. 6B, when the leading end of the sheet 3 passes the image formable region N for black, the centerline L2 of the sheet 3 deviates from the centerline L1 of the image formable region N by a displacement amount (hereinafter, referred to as a "center displacement amount W"). That is, a linear image GK of black is formed at the position of the sheet 3 deviated by the center displacement amount W. Accordingly, the center deviation occurs.

Figure 6C:
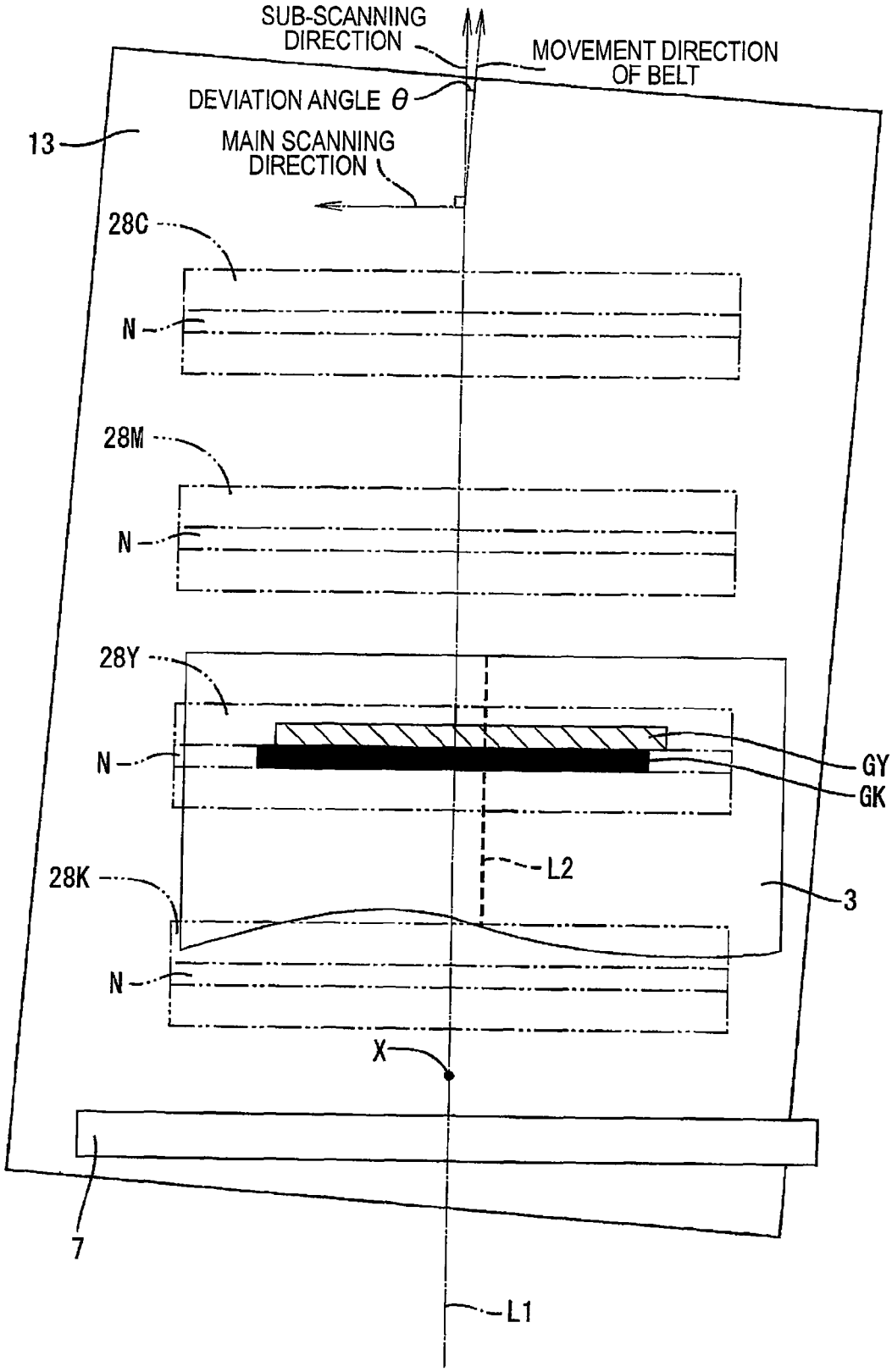
FIG. 6C is a schematic view showing a state where a linear image of yellow is formed on a sheet, when viewed from the above of the belt.
Figure 6D:
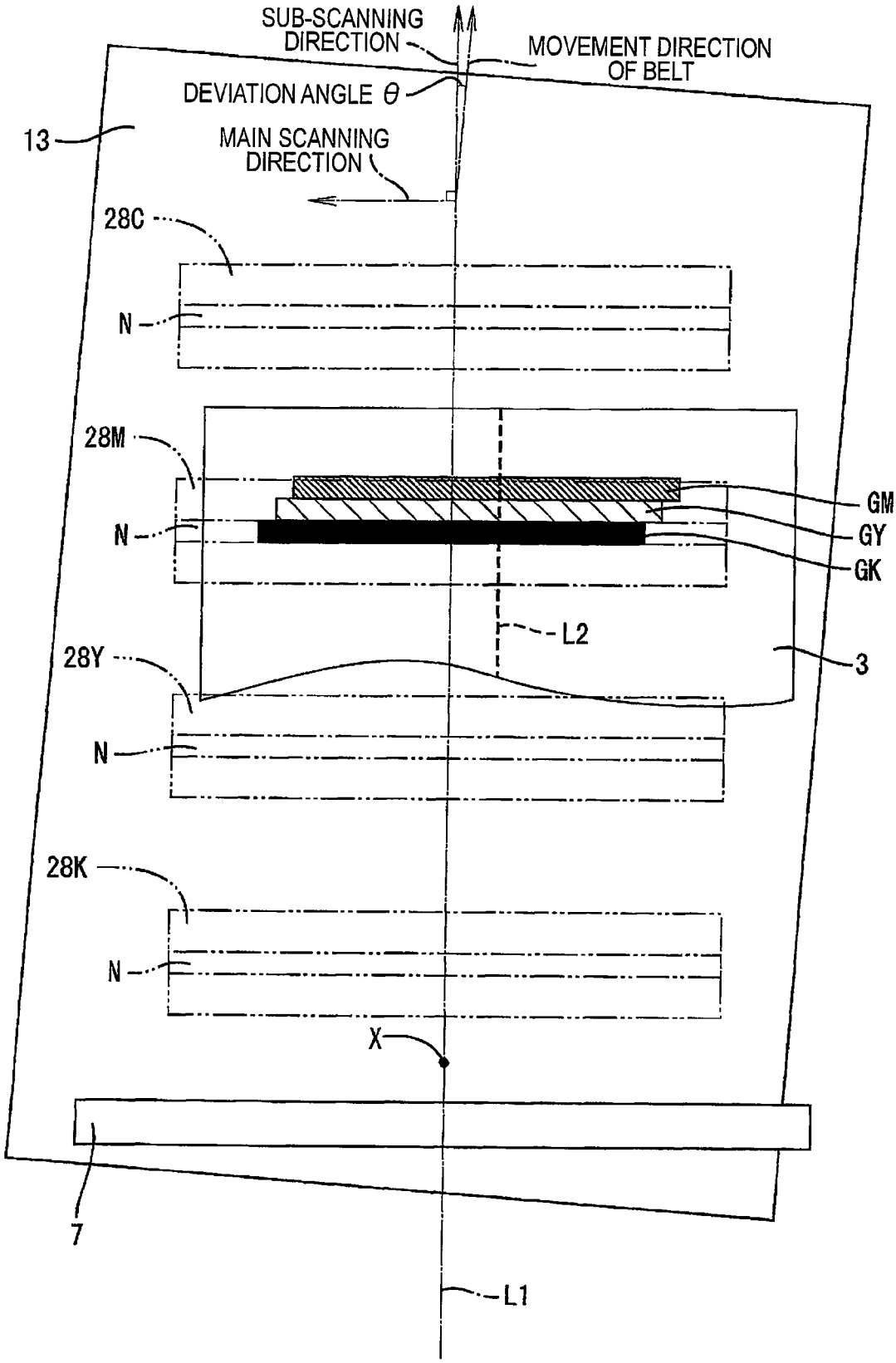
FIG. 6D is a schematic view showing a state where a linear image of magenta is formed on a sheet, when viewed from the above of the belt.
Figure 6E:
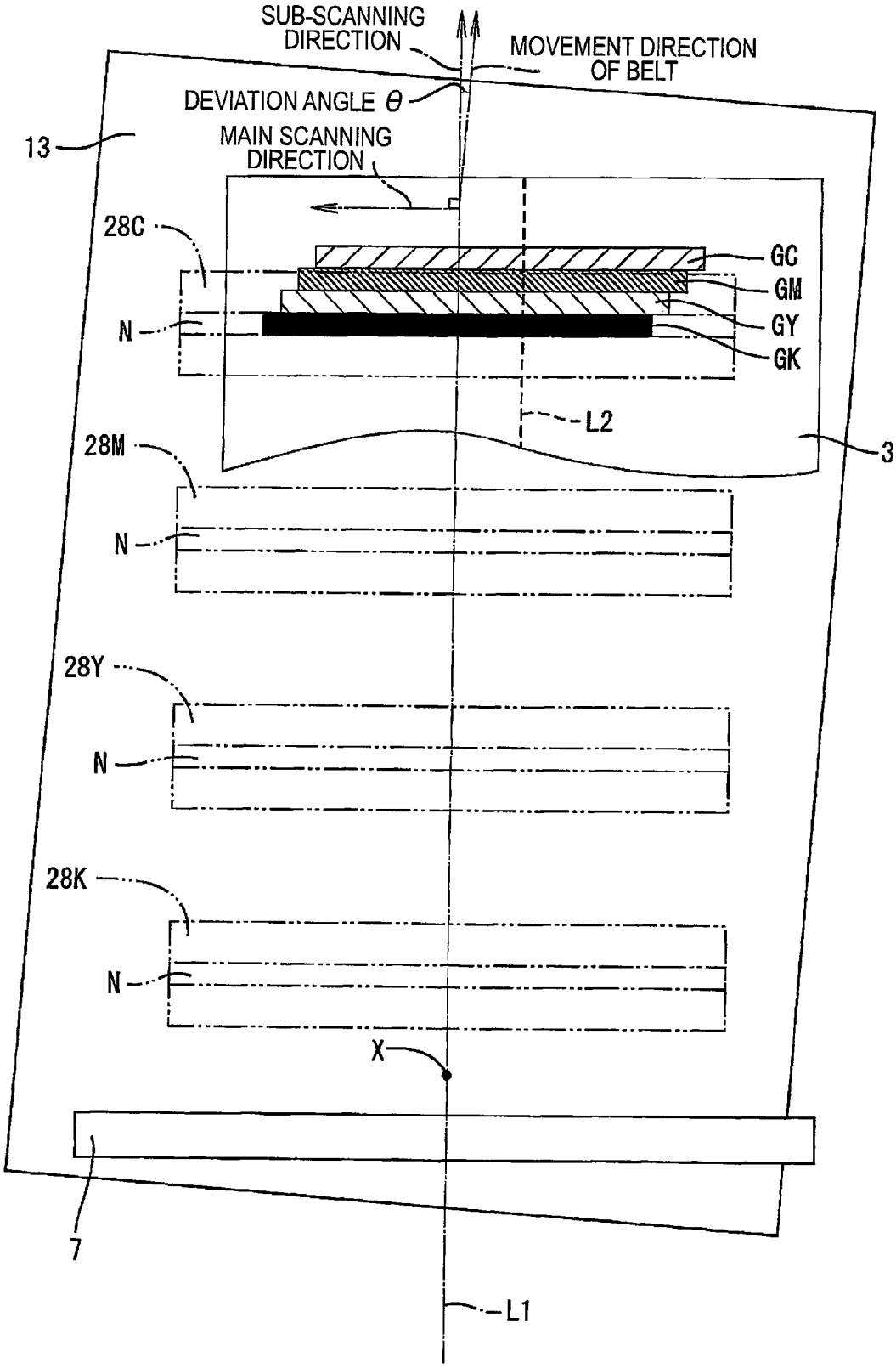
FIG. 6E is a schematic view showing a state where a linear image of cyan is formed on a sheet, when viewed from the above of the belt.
Figure 7:
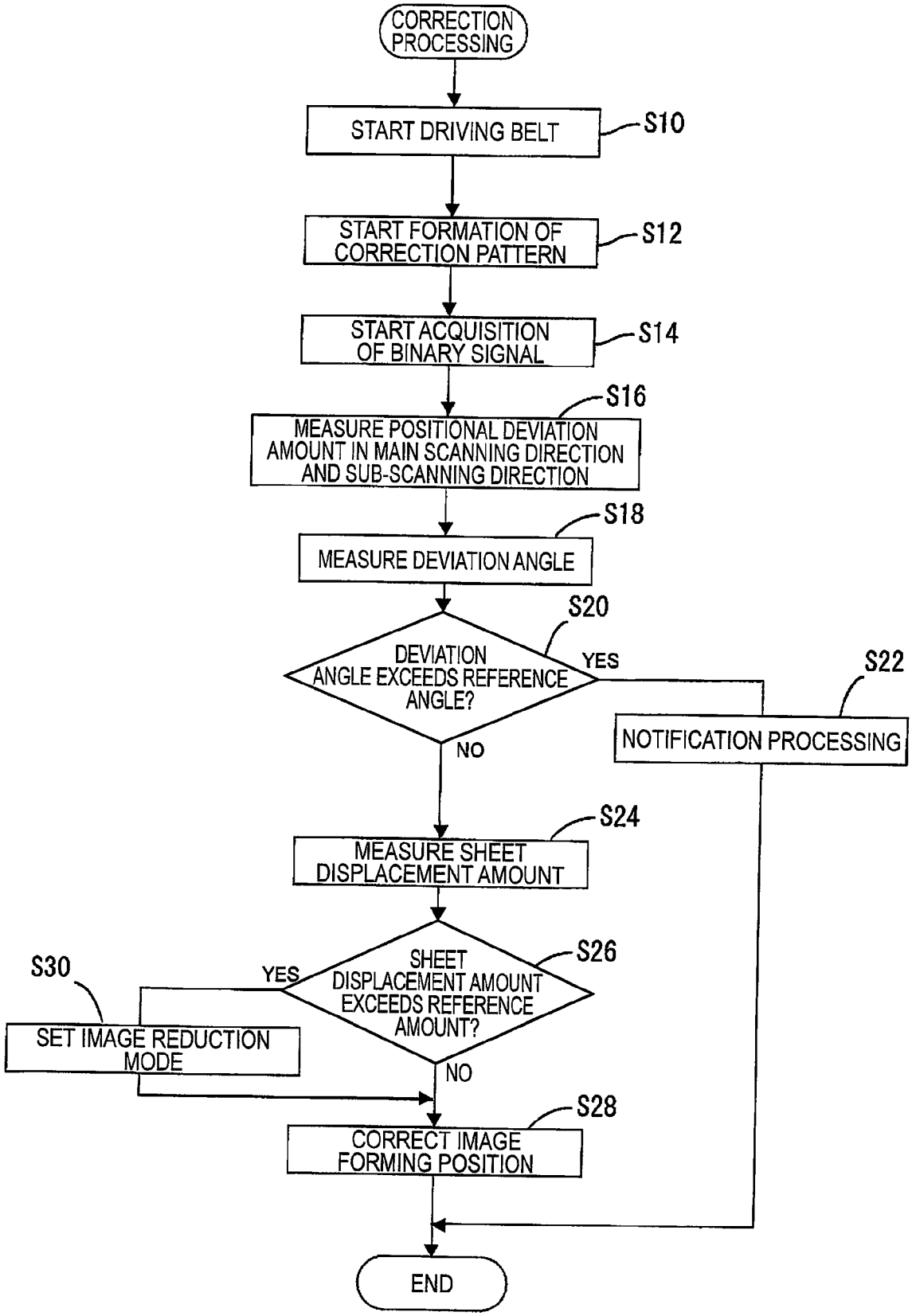
FIG. 7 is a flow chart showing a correction processing according to an illustrative embodiment of the present invention.

Then, as shown to FIG. 6C, when the leading end of the sheet 3 passes the image formable region N for yellow, the center displacement amount W becomes larger. As a result, a linear image GY of yellow is formed at the position deviated in the main scanning direction from the linear image GK of black. Similarly, a linear image GM of magenta is formed at the position deviated in the main scanning direction from the linear image GY of yellow as shown in FIG. 6D, and a linear image GC of cyan is formed at the position deviated in the main scanning direction from the linear image GM of magenta as shown in FIG. 6E. That is, positional deviation occurs.

(Correction Processing)

Next, the correction processing will be described with reference to FIG. 7 and FIGS. 8A to 8D.

The CPU 40 performs the correction processing when a predetermined condition is satisfied, such as replacement of the formation unit 20 or the belt unit 11, elapse of a predetermined time from the previous correction processing, or a condition where the number of sheets 3 on which images were formed reaches a predetermined number of sheets. By performing the correction processing, it is possible to correct the center deviation and the positional deviation in the main scanning direction and the sub-scanning direction.

First, the CPU 40 starts the driving mechanism 47 to rotate the belt 13 (S10). It is noted that transport of the sheet 3 has not started yet. Then, the CPU 40 controls each formation unit 20 to start forming the correction pattern P at the position corresponding to the detection region E of each mark sensor 15 on the belt 13 (S12), and then starts acquisition of the binary signal S2 from the mark sensor 15 (S14).

Figure 8A:
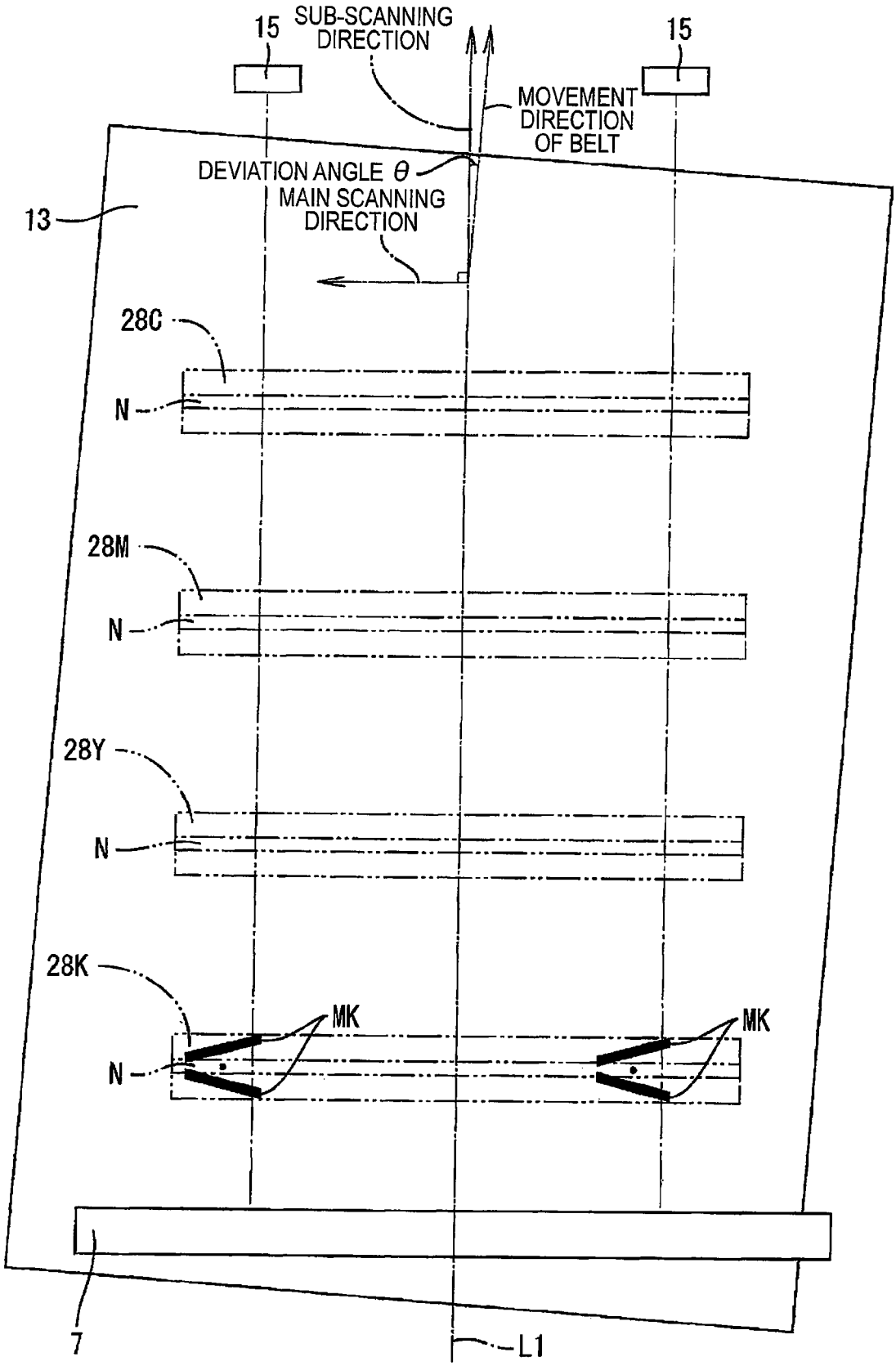
FIG. 8A is a schematic view when a black mark is formed in a state where the deviation angle exists.
Figure 8B:
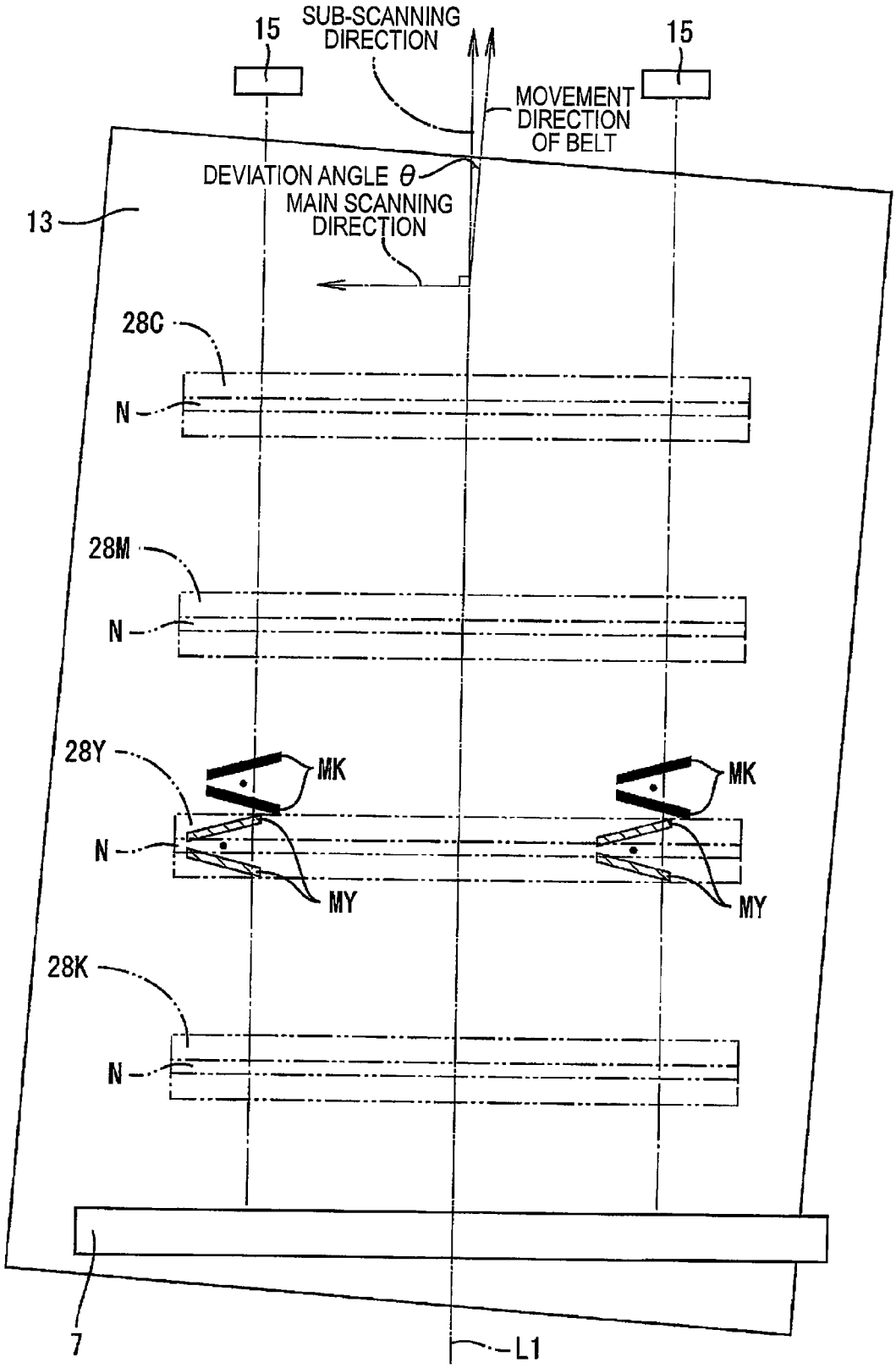
FIG. 8B is a schematic view when a yellow mark is formed in a state where the deviation angle exists.

Here, the black mark MK is formed in the image formable region N for black as shown in FIG. 8A, and then the yellow mark MY is formed when the black mark MK has passed the image formable region N for yellow, as shown in FIG. 8B. At this time, the black mark MK has moved to the position deviated in the sub-scanning direction from the yellow mark MY according to the deviation angle θ.

Figure 8C:
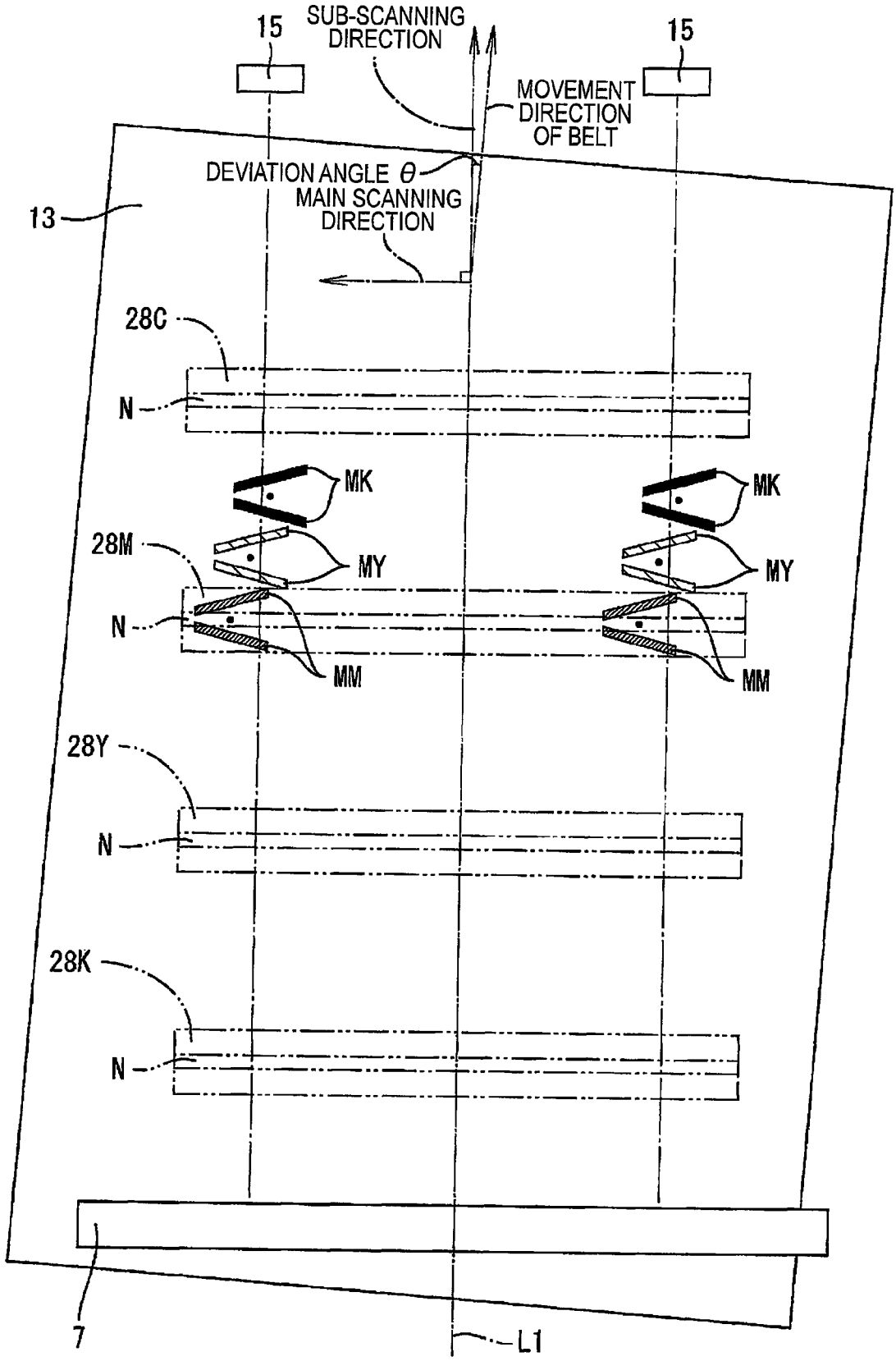
FIG. 8C is a schematic view when a magenta mark is formed in a state where the deviation angle exists.
Figure 8D:
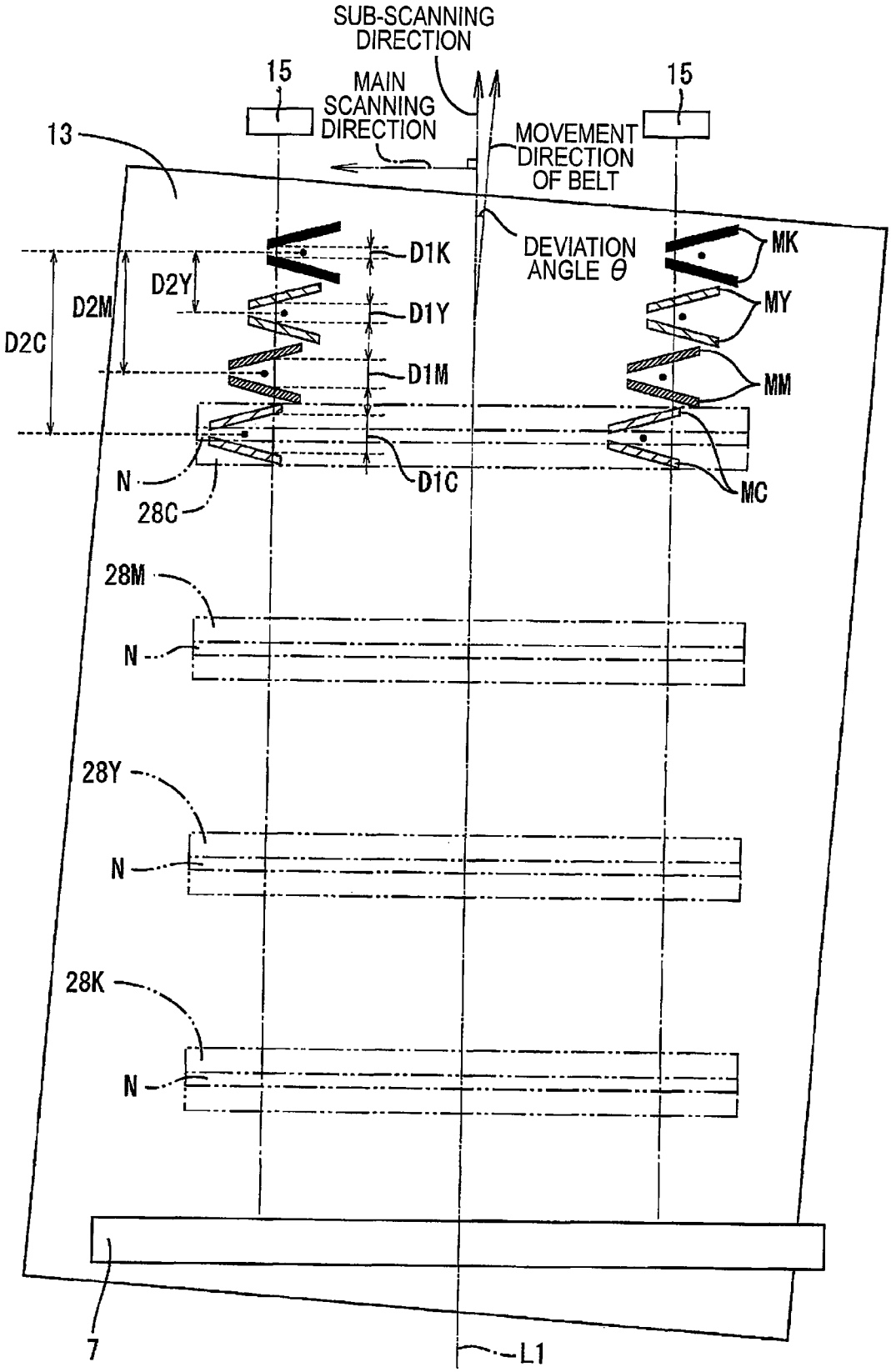
FIG. 8D is a schematic view when a cyan mark is formed in a state where the deviation angle exists.

Then, as shown in FIG. 8C, when the yellow mark MY has passed the image formable region N for magenta, the magenta mark MM is formed. At this time, each of the black mark MK and the yellow mark MY has moved to the position deviated in the sub-scanning direction from the magenta mark MM according to the deviation angle θ. Then, as shown in FIG. 8D, when the magenta mark MM has passed the image formable region N for cyan, the cyan mark MC is formed. At this time, each of the black mark MK, the yellow mark MY, and the magenta mark MM have moved to the position deviated in the sub-scanning direction from the cyan mark MC according to the deviation angle θ.

Thereafter, the CPU 40 obtains the mark width D1K, D1Y, D1M, and D1C of each mark M and the inter-mark distance D2Y, D2M, and D2C based on the binary signal S2 (refer to FIG. 8D). Then, the amount of positional deviation in the main scanning direction and the sub-scanning direction is measured (calculated) based on the detection result (S16).

Specifically, the CPU 40 calculates the average value of the mark width D1 for each mark M, and calculates an amount corresponding to the relative value of the mark width D1 between the reference color mark MK and each of the adjustment color marks MY, MM, and MC, as a positional deviation amount Z1 of each adjustment color image with respect to a reference color image in the main scanning direction. Then, in order to offset the positional deviation amount Z1, the CPU 40 calculates the positional deviation correction value for adjusting the start timing of emission of the exposure sections 17Y, 17M, and 17C (for example, a timing of an LED head 18 for exposing one end point of a head line of an adjustment color image). Then, this positional deviation correction value is stored in the NVRAM 43.

Then, the CPU 40 obtains the inter-mark distance D2Y, D2M, and D2C for each mark group of the correction pattern P, and calculates the average value of the inter-mark distance D2 over all mark groups for each of the yellow mark MY, the magenta mark MM, and the cyan mark MC. A deviation between the calculated average value of each color mark and a predetermined value, which corresponds to the inter-mark distance when the positional deviation amount of the adjustment color image with respect to the reference color image in the sub-scanning direction is substantially zero, is set as the positional deviation amount Z2 of the adjustment color image with respect to the reference color image in the sub-scanning direction.

Then, in order to offset the positional deviation amount Z2, the CPU 40 calculates the positional deviation correction value for adjusting the start timing of emission of the exposure sections 17Y, 17M, and 17C (for example, a timing of an LED head 18 for exposing one end point of a head line of an adjustment color image). Then, this positional deviation correction value is stored in the NVRAM 43.

Then, the CPU 40 obtains the deviation angle θ based on the positional relationship between the marks M of four colors (S18). The positional deviation amount Z1 in the main scanning direction corresponds to the amount of movement of the reference color image in the main scanning direction when the belt 13 has moved by the distance (=L3+D2), which is obtained by adding the distance L3 between the image formable regions N of the reference color and each adjustment color to the inter-mark distance D2 from a point of time when the reference color image is formed. It is noted that the distance L3 between the image formable regions N is determined from the structure of the printer 1. In this illustrative embodiment, the distance between the adjacent image formable regions N is set to be substantially constant.

Figure 9:
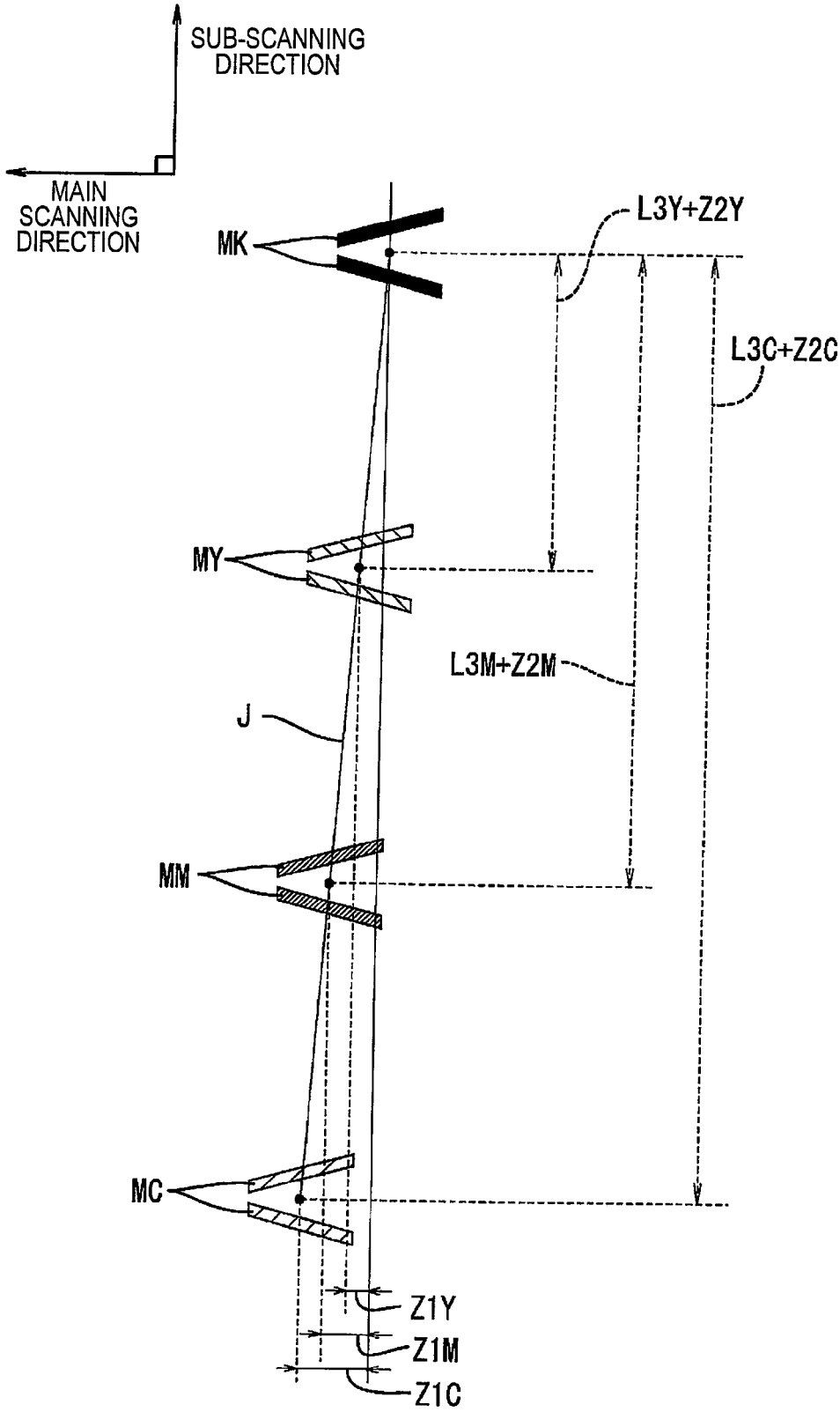
FIG. 9 is a schematic view showing the positional relationship of each mark.

FIG. 9 shows the positional relationship between the marks M for respective colors in relation to the positional deviation amount Z2, the distance L3, and the inter-mark distance D2. From the position of each mark M determined by this positional relationship, an approximate straight line J is calculated by, for example, the least square method. This approximate straight line J is assumed to be the movement direction of the belt 13. Here, the positions of the four marks M are not necessarily located in a line on the straight line. This is because the image formable regions N deviate from each other in the sub-scanning direction due to the arrangement variation of the exposure section 17 of each color, for example. That is, using the approximate straight line J means that the overall arrangement tendency is regarded as more important than the subtle position variation of four marks M, so that the movement direction of the belt 13 can be calculated more precisely while an influence such as the arrangement variation between exposure sections 17 is reduced. Then, the angle between the approximate straight line J and the sub-scanning direction can be calculated as the deviation angle θ.

Subsequently, it is determined whether the deviation angle θ exceeds a reference angle (S20). If it is determined that the deviation angle θ exceeds a reference angle (S20: YES), the belt 13 is regarded as being so inclined from the sub-scanning direction that the image quality is largely influenced, and for example, an image is not settled within the sheet 3. In this case, a notification processing is performed (S22), and the correction processing ends.

When it is determined that the deviation angle θ exceeds the reference angle, it is expected that the belt 13 is deteriorated and largely skews in the left-right direction or that the belt unit 11 is provided in a state of being largely inclined. Accordingly, in the notification processing, for example, a message of an instruction of replacement of the belt 13 or a message of an instruction of rearrangement of the belt unit 11 is displayed on the display section 45 (an example of a notification section) so that the user is notified. Thus, by notifying the instruction of replacement or the like to the user, the occurrence of image deviation (positional deviation and/or center deviation) caused by the deviation angle θ can be suppressed. Alternatively, the instruction may also be notified to a terminal apparatus (for example, a personal computer) which is communicably connected to the printer 1. It is noted that, the notification method is not limited to the image display, and sound, lighting of a lamp, or the like may be used.

At S20, if it is determined that the deviation angle θ is equal to or smaller than the reference angle (S20: NO), it is specified (calculated) the center displacement amount W from a point when the leading end of the sheet 3 reaches the pressed position X to a point when an end position of a margin of the leading end of the sheet 3 reaches the image formable region N of the reference color, that is, to a point at which the head image line is to be formed (S24). The center displace amount W specified in S24 is especially referred to as a center displacement amount W'. Specifically, as shown in FIG. 6B, the center displacement amount W' can be specified from the deviation angle θ and the added distance of the distance L4 from the pressed position X to the image formable region N of the reference color and the margin width L5 of the sheet 3 (margin width L5 may not be considered).

Then, if the center displacement amount W' is equal to or smaller than a reference amount (S26: NO), the center deviation correction value for adjusting the start timing of emission of the exposure section 17K (for example, a timing of an LED for exposing one end point of a head line of a reference color image) is calculated to reduce the amount of deviation of the image forming position of the reference color with respect to the sheet 3, which occurs according to the center displacement amount W', and the center deviation correction value is stored, for example, in the NVRAM 43 (S28). Then, the correction value of positional deviation in the main scanning direction for each adjustment color stored in the NVRAM 43 is updated to a value obtained by adding the center deviation correction value to the positional deviation correction value, and the correction processing ends.

At S26, if the center displacement amount W' exceeds the reference amount (S26: YES), there is a possibility that a part of an image will be formed out of the sheet 3 if the image is formed on the sheet 3 in this state. Therefore, an image reduction mode for reducing an image in image formation performed thereafter is set (S30), and the process proceeds to S28. It is noted that the reduction rate may be a fixed rate set in advance or a rate corresponding to the difference between the center displacement amount W' and the reference amount, for example.

If an image is formed on the sheet 3 after performing the correction processing described above, the image is formed at the image forming position corresponding to the center deviation correction value and the positional deviation correction value. As a result, an image can be formed on the sheet 3 while suppressing the center deviation and/or the positional deviation.

(Effects of the Illustrative Embodiment)

According to the above-described illustrative embodiment, the positional relationship of the marks M of four colors can be specified based on the binary signal from the mark sensor 15, and the relative deviation angle θ between the sub-scanning direction and the movement direction of the belt 13 can be measured based on the positional relationship.

Further, the center deviation can be corrected based on the measured deviation angle θ. It is noted that, as described above, the deviation angle θ is less effective at the pressure position X of the absorption roller 7. Therefore, by calculating the center displacement amount W with the pressure position as a reference and calculating the center deviation correction value based on the center displacement amount W, the center deviation can be corrected more precisely.

Further, using the mark M having a pair of stripe-shaped marks, it is possible to specify not a relative positional relationship of marks from a last correction processing but an absolute positional relationship with respect to the defined position set in advance. Accordingly, it is possible to easily measure the deviation angle without requiring processing for accumulating the positional relationship up to the last correction processing.

<Other Illustrative Embodiments>

While the present invention has been shown and described with reference to certain illustrative embodiments thereof, it will be understood by those skilled in the art that various changes in form and details may be made therein without departing from the spirit and scope of the invention as defined by the appended claims.

(1) In the above-described illustrative embodiment, the direct transfer type color printer which forms a color image is described as an example, however, the present invention is not limited thereto. The present invention may be applied to an intermediate transfer type printer. In this case, an intermediate transfer body is an example of the moving body. Further, the present invention may be applied to an image forming apparatus which uses other electrophotographic methods, such as a polygon scanning method or an ink jet method.

(2) In the above-described illustrative embodiment, the sheet 3 is pressed on the belt 13 by the absorption roller 7, the absorption roller 7 may be in contact with the belt 13. Further, the absorption roller 7 may not be a roller body, and may be a plate member, for example. That is, any member which presses the sheet 3 on the belt 13 may be used.

(3) In the above-described illustrative embodiment, the mark M including a pair of stripe-shaped marks formed line-symmetrically is described as an example, however, the present invention is not limited thereto. The pair of stripe-shaped marks may not be provided line-symmetrically. In addition, it is possible to use a mark including a single stripe-shaped mark having a width (thickness) in the sub-scanning direction changes with the position in the main scanning direction (for example, a mark which gradually becomes thick in the main scanning direction). That is, if a mark has a pair edge portions with a distance therebetween changes as proceeding in the main scanning direction, it is possible to specify not only the relative positional relationship between the reference color mark and the adjustment color mark but also the absolute positional relationship of each color mark M (position on the belt 13 in the main scanning direction).

In addition, if a mark with which the amount of positional deviation between respective color marks in the main scanning direction can be measured is used, it is possible to measure the deviation angle. That is, it is also conceivable to use a shift pattern which has a plural sets of mark pairs with different overlap states between a reference color mark and an adjustment color mark (for example, refer to JP-A-2008-292811 or JP-A-2008-292812, which are incorporated herein by reference).

(4) In the above-described illustrative embodiment, as image variations, the center deviation and the positional deviation are corrected, however, the present invention is not limited thereto. Each color image may deform due to the presence of the deviation angle θ. For example, if a square shaped image is formed by each formation unit 20, an image formed on the sheet 3 deforms into the shape of a rhombus. Accordingly, in the above-described illustrative embodiment, processing for correcting the start position (start position of exposure) for every line may be additionally performed for each color image so that image deformation caused by the deviation angle θ is offset.

(5) In the above-described illustrative embodiment, the movement direction of the belt 13 is calculated from the approximate straight line using the least square method, however, the present invention is not limited thereto. For example, the direction of a straight line passing through the positions of the marks M of two colors among the marks M of four colors may be set as a movement direction of the belt 13. In this case, it is advantageous that the marks M of the two colors are marks formed by the formation units 20K located at the most upstream side and 20C located at the most downstream side in the movement direction of the belt 13.

(6) In the above-described illustrative embodiment, the deviation angle is measured using the amount Z2 of positional deviation in the main scanning direction, the distance L3, and the distance D2 between marks, however, the invention is not limited thereto. For example, the correspondence relationship between the deviation angle and the amount of positional deviation in the main scanning direction may be calculated and stored in the NVRAM 43 in advance, and the deviation angle may be measured (calculated) based on the correspondence relationship with the amount of positional deviation. In addition, it may be considered that an influence of the distance D2 between marks on the measurement of a deviation angle is small, and therefore, the distance D2 between marks may not be considered.

(7) In the above-described illustrative embodiment, the measured deviation angle is used for determination of center deviation correction or belt replacement instruction, however, the present invention is not limited thereto. For example, a signal (for example, a measurement signal of a deviation angle or a signal corresponding to a result of size determination of the deviation angle and the reference angle) corresponding to the deviation angle may be output to an external apparatus (for example, a personal computer communicably connected to the printer 1).

(8) In the above-described illustrative embodiment, the marks M are formed directly on the belt 13, however, the present invention is not limited thereto. The marks M may be formed on the sheet 3 transported on the belt 3.

The present invention provides illustrative, non-limiting embodiments as follows:

[1] An image forming apparatus comprising: a moving body which is configured to move in a moving direction; a plurality of formation units which are provided to oppose the moving body, respectively, and align in an alignment direction, and which are configured to sequentially form images directly on the moving body or an image forming medium transported on the moving body; a detection section which is configured to output a detection signal corresponding to a position of a mark which is formed directly on the moving body or the image forming medium transported on the moving body by each of the formation units; and a measurement section which is configured to specify a positional relationship between marks, which are formed by at least two formation units, based on the detection signal from the detection section, and which is configured to measure a deviation angle between the moving direction of the moving body and the alignment direction of the formation units based on the specified positional relationship.

According to this configuration, it is possible to specify the positional relationship between marks formed by at least two formation units based on the detection signal from the detection section and to measure the deviation angle between the alignment direction of the image forming positions of the plurality of formation units and the movement direction of the moving body based on the specified positional relationship.

[2] In the above-described image forming apparatus, the measurement section may be configured to specify the positional relationship of marks, which are formed by three or more formation units, based on the detection signal from the detection section, and is configured to measure the deviation angle based on an approximate straight line corresponding to the positional relationship.

According to this configuration, the deviation angle is measured based on the approximate straight line corresponding to the positional relationship of marks formed by three or more formation units. In this case, for example, compared with a configuration where the deviation angle is measured based on the positional relationship of marks formed by two adjacent formation units, the deviation angle can be measured with high precision.

[3] The above-described image forming apparatus may further comprise: a correction section which is configured to correct an image forming position of at least one formation unit based on the deviation angle measured by the measurement section such that image variation caused by the deviation angle is suppressed.

According to this configuration, it is possible to suppress an image variation caused by the deviation angle (for example, deformation of an image caused by positional deviation and a deviation angle in a direction perpendicular to the transport direction).

[4] In the above-described image forming apparatus, the correction section may be configured to specify, based on the deviation angle, a displacement amount of an image forming medium transported on the moving body from a reference point, in a direction perpendicular to the alignment direction, and may be configured to correct the image forming position such that a deviation amount of the image forming position with respect to the image forming medium in the perpendicular direction, which is caused according to the displacement amount, is reduced.

If a deviation angle occurs when the image is formed, the image forming medium is displaced in a direction perpendicular to the alignment direction of a plurality of formation units as the image forming medium is transported by the moving body. Therefore, a problem in image formation may occur in which the position of an image with respect to the image forming medium deviates from the planned position.

According to the above configuration, the amount of displacement of the image forming medium in the perpendicular direction from the reference point is specified based on the deviation angle and the image forming position is corrected so that the amount of deviation of the image forming position with respect to the image forming medium, which occurs corresponding to the displacement amount, is reduced.

Accordingly, the problem in the image formation cause by the deviation angle can be suppressed.

[5] In the above-described image forming apparatus, the reference point may be set at a position further upstream in the moving direction than the image forming position of the most upstream formation unit among the plurality of formation units.

According to this configuration, it is also possible to suppress a problem in image formation caused by the displacement amount further to the upstream side than the image forming position of the formation unit on the most upstream side.

[6] The above-described image forming apparatus may further comprise a pressing member which is provided at an upstream from the image forming position of the most upstream formation unit, and which is configured to press the image forming medium toward the moving body. The reference point may be set at a pressure position to which the image forming medium is pressed by the pressing member or at a position further downstream than the pressure position in the moving direction.

According to this configuration, it is possible to specify the displacement amount more precisely by setting the reference point at the position where the image forming medium is reliably pressed on the moving body.

[7] In the above-described image forming apparatus, the correction section may be configured to reduce a size of an image to be formed on the image forming medium when the displacement amount exceeds a reference amount.

According to this configuration, even if the displacement amount is large, the image can be normally formed at the planned position on the image forming medium without missing of a part of the image by reducing the image.

[8] The above-described image forming apparatus may further comprise: a notification section which is configured to notify that replacement of the moving body is necessary when the deviation angle exceeds a reference angle.

According to this configuration, when the deviation angle is large, deterioration of the moving body is considered, for example. Accordingly, by notifying it to the user, the occurrence of an image variation caused by the deviation angle can be suppressed.

[9] In the above-described image forming apparatus, the mark may have a pair of edge portions with a distance therebetween changes as proceeding in a direction perpendicular to the alignment direction, and the measurement section may be configured to specify an absolute positional relationship of each mark with respect to a predetermined position, based on the detection signal which varies according to the distance between the pair of edge portions.

According to this configuration, it is possible to specify the absolute positional relationship with respect to the predetermined position instead of the relative positional relationship of marks from the point of time of last correction at which correction (including the registration in the related art) of the image forming position was performed, for example. Therefore, it is possible to easily measure the deviation angle without requiring processing for accumulating the positional relationship up to the last correction.

What is claimed is:

1. An image forming apparatus comprising:

a moving body which is configured to move in a moving direction;

a plurality of formation units which are provided to oppose the moving body, respectively, and align in an alignment direction, and which are configured to sequentially form images directly on the moving body or an image forming medium transported on the moving body; and a controller configured to function as:

a detection section which is configured to output a detection signal corresponding to a position of a mark which is formed directly on the moving body or the image forming medium transported on the moving body by each of the formation units; and a measurement section which is configured to specify a positional relationship between marks, which are formed by at least two formation units, based on the detection signal from the detection section, and which is configured to calculate a deviation angle between the moving direction of the moving body and the alignment direction of the formation units based on the specified positional relationship.

2. The image forming apparatus according to claim 1, wherein the measurement section is configured to specify the positional relationship of marks, which are formed by three or more formation units, based on the detection signal from the detection section, and is configured to calculate the deviation angle based on an approximate straight line corresponding to the positional relationship.

3. The image forming apparatus according to claim 1, wherein the controller is further configured to function as a correction section which is configured to correct an image forming position of at least one formation unit based on the deviation angle calculate by the measurement section such that image variation caused by the deviation angle is suppressed.

4. The image forming apparatus according to claim 3, wherein the correction section is configured to specify, based on the deviation angle, a displacement amount of an image forming medium transported on the moving body from a reference point, in a direction perpendicular to the alignment direction, and is configured to correct the image forming position such that a deviation amount of the image forming position with respect to the image forming medium in the perpendicular direction, which is caused according to the displacement amount, is reduced.

5. The image forming apparatus according to claim 4, wherein the reference point is set at a position further upstream in the moving direction than the image forming position of the most upstream formation unit among the plurality of formation units.

6. The image forming apparatus according to claim 5, further comprising:

a pressing member which is provided upstream from the image forming position of the most upstream formation unit, and which is configured to press the image forming medium toward the moving body, wherein the reference point is set at a pressure position to which the image forming medium is pressed by the pressing member or at a position further downstream than the pressure position in the moving direction.

7. The image forming apparatus according to claim 4, wherein the correction section is configured to reduce a size of an image to be formed on the image forming medium when the displacement amount exceeds a reference amount.

8. The image forming apparatus according to claim 1, further comprising:

a notification section which is configured to notify that replacement of the moving body is necessary when the deviation angle exceeds a reference angle.

9. The image forming apparatus according to claim 1, wherein the mark has a pair of edge portions with a distance therebetween changing when proceeding in a direction perpendicular to the alignment direction, and wherein the measurement section is configured to specify an absolute positional relationship of each mark with respect to a predetermined position, based on the detection signal which varies according to the distance between the pair of edge portions.

* * * * *

UNITED STATES PATENT AND TRADEMARK OFFICE

CERTIFICATE OF CORRECTION

PATENT NO. : 8,260,181 B2
APPLICATION NO. : 12/726363
DATED : September 4, 2012
INVENTOR(S) : Kentaro Murayama It is certified that error appears in the above-identified patent and that said Letters Patent is hereby corrected as shown below:

In the Claims:

Column 14, Claim 3, Line 29:
Please delete "calculate by" and replace with --calculated by--

Signed and Sealed this
Fourth Day of June, 2013

Teresa Stanek Rea
*Acting Director of the United States Patent and Trademark Office*